US005219487A

United States Patent [19]

Heile, Jr. et al.

[11] Patent Number: 5,219,487

[45] Date of Patent: Jun. 15, 1993

[54] AERATED BAR SOAP COMPOSITION CONTAINING FREE FATTY ACID

[75] Inventors: Kenneth A. Heile, Jr.; Robert J. Schrand, both of Cincinnati; James E. Taneri, West Chester, all of Ohio

[73] Assignee: The Procter & Gamble Company, Cincinnati, Ohio

[21] Appl. No.: 949,743

[22] Filed: Sep. 23, 1992

Related U.S. Application Data

[63] Continuation of Ser. No. 655,273, Feb. 13, 1991, abandoned, which is a continuation of Ser. No. 293,386, Jan. 4, 1989, abandoned.

[51] Int. Cl.[5] ..... C11D 9/00; C11D 9/10

[52] U.S. Cl. ..... 252/108; 252/367; 252/368; 252/369; 252/370; 252/134; 252/174; 252/132; 252/DIG. 5; 252/DIG. 16

[58] Field of Search ..... 252/367-370, 252/134, 174, DIG. 16, 132, DIG. 5, 108

[56] References Cited

U.S. PATENT DOCUMENTS

| | | | |
|---|---|---|---|
| 3,247,119 | 9/1966 | Goldwasser et al. | 252/368 |
| 3,657,146 | 4/1972 | Fransen et al. | 252/369 |
| 3,835,058 | 9/1974 | White | 252/129 |

FOREIGN PATENT DOCUMENTS 1033421 6/1966 United Kingdom .

OTHER PUBLICATIONS

*Industrial Oil & Fat Products*, Aeton E. Bailey, 1945, pp. 14-15.

*Industrial Oil and Fat Products*, Bailey, 1945, pp. 14-15.

*Fatty Acids and their Derivatives*, Ralston, 1948, pp. 428-438.

*Fatty Acids: Their Chemistry, Properties, Production and Users*, Part 5, Markley (ed.), 1968, pp. 3360-3368.

*Primary Examiner*—Christine Skane
*Assistant Examiner*—Kery A. Fries
*Attorney, Agent, or Firm*—Robert B. Aylor

[57] ABSTRACT

Aerated soap bar compositions which contain a limited amount of free fatty acid and salt have improved processing and physical characteristics if the fatty acid soap comprises only a limited amount of trans fatty acids. Superior wet crack and bar feel grades are found, as opposed to similar bars having higher trans fatty acid content. Higher amounts of fatty acid require less inorganic salt for proper viscosity of the crutcher mix.

12 Claims, No Drawings

AERATED BAR SOAP COMPOSITION CONTAINING FREE FATTY ACID

This is a continuation of application Ser. No. 07/655,273, filed on Feb. 13, 1991, which is a continuation of application Ser. No. 07/293,386, filed Jan. 4, 1989, now abandoned.

TECHNICAL FIELD

This invention relates to aerated bar soap compositions of the type disclosed in U.S. Pat. No. 3,835,058, White, issued Sep. 10, 1974, incorporated herein by reference. Such aerated bar soap compositions containing free fatty acid are highly desirable from the standpoint of compatibility with the skin and lathering.

BACKGROUND ART

U.S. Pat. No. 3,835,058 generally discloses compositions of the type found in this invention. The kinds and levels of ingredients are similar. The soap mixture is dried to a moisture content of from 18% to 30%.

SUMMARY OF THE INVENTION

The present invention relates to the discovery that aerated bar soap compositions containing free fatty acids have dramatically improved wet crack grades and bar feel if the fatty acids used in the soap contain less than about 15% trans fatty acids, as determined by separating the fatty acids from the bar soap composition and analyzing them. Also, the level of inorganic salts that can be present in the bar soap composition is directly related to the amount of fatty acids present. The higher the amount of fatty acid present the less inorganic salt can be present to maintain proper viscosity of the crutcher mix.

The aerated bar soap compositions of this invention contain from about 70% to about 80%, preferably from about 73% to about 75%, of an alkali metal fatty acid soap in which said fatty acids contain from about 8 to about 18 carbon atoms and have a percentage of trans fatty acids of less than about 15%, preferably less than about 14%; from about 0.5% to about 5%, preferably from about 1% to about 3%, free fatty acid containing from about 8 to about 18 carbon atoms; and there being no more than about 0.75% of salt when the free fatty acid content is at 1% or less and for each additional percent of free fatty acid that is present the maximum salt content is reduced by about one-tenth-of 1%.

DETAILED DESCRIPTION OF THE INVENTION

The alkali metal soap components suitable for use in the process of the present invention include the water-soluble soaps normally used in bar soap processing as limited herein. These include the sodium and potassium soaps of higher fatty acids or mixtures thereof. The sodium soaps, particularly those derived from mixtures of coconut and tallow oils are preferred. Water-soluble soaps made from other fats or fatty acids can also be used as will be evident to those skilled in the art.

The soaps of the present invention will normally contain from 8 to 18 carbon atoms. Commercial soaps preferred herein are generally based upon mixtures of fatty acids obtained from various natural sources. Coconut oil, for example, is a material which has found considerable use in high-quality soap compositions. Similarly, tallow is a useful source of high-quality soaps.

Other suitable sources include palm kernel oil and babassu kernel oil which are included within the term "coconut oil", olive oil and synthetic fatty acids simulating, for example, tallow. Particularly useful herein are the sodium and potassium salts of the mixtures of fatty acids derived from coconut oil (CN) or palm kernel oil (PKO) and tallow (T), i.e., sodium or potassium tallow and coconut soap. Preferred soap mixtures are the tallow/(coconut or palm kernel oil) soaps ranging in proportions from 70:30 to 50:50 by weight. These soap mixtures are preferred from the standpoint of ready availability, ease of processing and their desirably optimum physical and performance characteristics.

The term "coconut" as used herein in connection with soap or free fatty acid mixtures refers to materials having an approximate carbon chain length distribution of: 8% $C_8$; 7% $C_{10}$; 48% $C_{12}$; 17% $C_{14}$; 9% $C_{16}$; 2% $C_{18}$; 7% oleic and 2% linoleic (the first six fatty acids being saturated).

The term "tallow" as used herein refers to a mixture of soaps having an approximate chain length distribution of: 2.5% $C_{14}$; 29% $C_{16}$; 23% $C_{18}$; 2% palmitoleic; 41.5% oleic and 3% linoleic (the first three fatty acids being saturated).

The fatty acids which can be used in the process of the invention are those having from 8 to 18 carbon atoms. Normally a mixture of free fatty acids derived from natural sources is employed. Preferred mixtures of fatty acids are the coconut/tallow fatty acid mixtures hereinbefore described. As discussed hereinbefore, the level of trans fatty acids should be minimized. The level of trans fatty acids is increased when the fatty acids are "hardened", e.g., by hydrogenation, so simply hydrogenating to a lower degree is a convenient way to obtain the desired fatty acids.

The free fatty acids improve the quantity and quality of the lathering characteristics of bars prepared in accordance with the process of the present invention. The advantage of free fatty acids in tending to provide a lather of desirable stability and having small air bubbles so as to provide a rich or creamy lather has been known in the art. Fatty acids also provide an emollient effect which tends to soften the skin or otherwise improve feel-on-skin characteristics and scavenge any excess alkalinity.

The amount of free fatty acid incorporated into the finished bars of the invention ranges from about 0.5% to about 5%. Below about 0.25%, the desirable advantages described hereinbefore are not readily apparent. Amounts greater that about 5% provide little further benefit without corresponding economic advantage and with increasingly negative processing effects on bar softening physical characteristics. A preferred amount of fatty acid ranges from about 1% to about 3%.

The free fatty acid can be incorporated into bars of the present invention in a number of suitable ways. The free fatty acid component is desirably incorporated into the soap mixture either prior to, or simultaneously with, the high-shear mixing step used to form the bar composition. Uniform distribution of the free fatty acid throughout the finished bar composition is facilitated by the high-shearing action. The free fatty acid component can be added subsequent to the high-shear mixing step if other subsequent mixing means are employed so as to substantially uniformly distribute the free fatty acid throughout the soap mixture or resulting bar composition.

The free fatty acid component is preferably introduced into the soap mixtures of the present invention by addition of the free fatty acid to the soap mixture in the initial crutching stage. Alternatively, the free- fatty acid component can be introduced prior to or during the aeration stage where perfume and other additives, if desired, are incorporated into the soap mixture. The free fatty acid component can also be introduced as a prepared mixture of soap and free fatty acid, such as an acid-reacting mixture of soap and free fatty acid prepared by under-neutralization in the soap making process.

The bar soap compositions of the present invention can contain other additives commonly included in toilet bars such as perfumes, sanitizing or antimicrobial agents, dyes, and the like. These additives make the finished bar compositions either more attractive or effective without detracting from the desirable attributes of the bar.

The bar compositions of the present invention can additionally contain a water-soluble organic nonsoap synthetic detergent. Normally the soap/synthetic bars are prepared to contain a ratio of soap to synthetic detergent of from about 3:1 to about 9:1. The choice of suitable ratios will depend upon the particular synthetic detergent, the desired performance and physical characteristics of the finished bar, temperature, moisture and like processing considerations. A preferred ratio is from about 5:1 to about 7:1.

The synthetic detergent constituent of the bar compositions of the invention can be designated as being a detergent from the class consisting of anionic, nonionic, ampholytic and zwitterionic synthetic detergents. Examples of suitable synthetic detergents for use herein are those described in U.S. Pat. No. 3,351,558, issued Nov. 7, 1967, at column 6, line 70 to column 7, line 74, incorporated herein by reference.

Preferred herein are the water-soluble salts of organic, sulfonic acids and of aliphatic sulfuric acid esters, that is, water-soluble salts of organic sulfuric reaction products having in the molecular structure an alkyl radical of from 10 to 22 carbon atoms and a radical selected from the group consisting of sulfonic acid and sulfuric acid ester radicals.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm kernel oil, babassu kernel oil or other oils of the coconut group can be used herein.

Other aliphatic sulfuric acid esters which can be suitably employed include the water-soluble salts of sulfuric acid esters of polyhydric alcohols incompletely esterified with high molecular weight soap-forming carboxylic acids. Such synthetic detergents include the water-soluble alkali metal salts of sulfuric acid esters of higher molecular weight fatty acid monoglycerides such as the sodium and potassium salts of the coconut oil fatty acid monoester of 1,2-hydroxypropane-3-sulfuric acid ester, sodium and potassium monomyristoyl ethylene glycol sulfate, and sodium and potassium monolauroyl diglycerol sulfate.

Preferred sulfonate detergents include the alkyl glyceryl ether sulfonate detergents (i.e., water-soluble salts of alkyl glyceryl ether sulfonic acid) having from 10 to 18 carbon atoms in the alkyl group. These sulfonates provide the bars of the invention with desirable lime soap- or scum-dispersing properties and can be conveniently processed to provide soap/synthetic bar compositions having the desirable uniformity of texture and appearance described hereinbefore. Preferably, they comprise from about 5% to about 15% of the finished bar compositions. These sulfonates can be made by first reacting fatty alcohols with epichlorohydrin and then reacting the alkyl chloroglyceryl ethers so formed with sodium or potassium sulfites. The preferred source of the fatty alcohols which are used in the foregoing reaction is coconut oil and like alcohols. The alkyl glyceryl ether sulfonates are described in greater detail in U.S. Pat. No. 2,989,547, issued Jun. 20, 1961.

The following examples illustrate the practice of this invention. All percentages, parts and ratios herein-are by weight unless otherwise specified.

EXAMPLE I

Base soap containing about 30% moisture and comprising a 70T/30PKO mixture of soap is dried to a moisture level of about 23.5% and minors are added. The levels of fatty acid and salt are as indicated. The soap with minors is pumped to a high shear mixer which mixes the fatty acid and soap and the resulting mixture is then put into a scraped wall heat exchanger where the temperature is lowered from about 215° F. to about 150° F.; the soap is extruded; plugs are cut, cooled and conditioned; and then the resulting bars are stamped, wrapped, bundled and packed. The formulas of the various compositions are as follows:

TABLE 1

| Ingredient | Control | Comp. 1 | Comp. 2 | Comp. 3 | Comp. 4 |
|---|---|---|---|---|---|
| Soap 70T/30PKO (100% Na) | — | 73.14 | 74.49 | 74.44 | 72.94 |
| Soap 70T/30PKO (80 Na/20 K) | 75.2 | — | — | — | — |
| Cn Free Fatty Acid | — | 2.50 | 1.00 | 1.00 | 2.75 |
| Water | 23.5 | 23.5 | 23.5 | 23.5 | 23.5 |
| Perfume | 0.16 | 0.16 | 0.16 | 0.16 | 0.16 |
| Preservative | 0.24 | 0.20 | 0.20 | 0.20 | 0.20 |
| NaCl | 0.90 | 0.50 | 0.65 | 0.70 | 0.45 |
| % Trans acid | 8-15 | 14.2 | 14.9 | 21.3 | 17.5 |
| Wet crack grade | 9 | 8 | 8 | 3 | 3 |
| Bar Feel Grade (Fresh) | 9 | 9 | 8 | 4 (rough) | 7 |
| Bar Feel Grade (Aged) | 8 | 9 | 7 | NA | 4 (rough) |

NA = Not Available

Compositions 1 and 2 exemplify successful formulas having low trans fatty acid content with good wet cracking and bar feel grades, whereas Compositions 3 and 4 with high trans fatty acids exemplify poor wet cracking and bar feel grades.

In the wet crack grades and the bar feel grades the scale is from 1 to 10 in which 1 is poor and 10 is excellent, the grade being assessed by a panel of 2-3 trained technical graders. The aged feel grade is determined after three months storage at 100° F.

What is claimed is:

1. An aerated bar soap composition comprising:

A. from about 70% to about 80% of alkali metal fatty acid soap in which said fatty acids contain from about 8 to about 18 carbon atoms and have a percentage of trans fatty acids of less than about 15%;

B. from about 0.5% to about 5% of free fatty acid containing from about 8 to about 18 carbon atoms;

C. no more than about 0.65% of salt when the free fatty acid content is at about 1% or less and for each additional about 1% of free fatty acid that is present the maximum salt content is reduced by about one-tenth of 1%; and D. the balance moisture.

2. The composition of claim 1 in which the trans fatty acid soap content is less than about 14%.

3. The composition of claim 2 in which the free fatty acid content is from about 1% to about 3%.

4. The composition of claim 1 in which the free fatty acid content is from about 1% to about 3%.

5. The composition of claim 1 in which the fatty acid soap and fatty acid are derived from a blend of (1) tallow fatty acids and (2) fatty acids selected from the group consisting of coconut oil fatty acids, palm kernel oil fatty acids, and mixtures thereof in ratios of (1) to (2) of from about 70:30 to about 50:50.

6. The composition of claim 5 in which the trans fatty acid soap content is less than about 14%.

7. The composition of claim 6 in which the free fatty acid content is from about 1% to about 3%.

8. The composition of claim 5 in which the free fatty acid content is from about 1% to about 3%.

9. An aerated bar soap composition comprising:

A. from about 70% to about 80% of alkali metal fatty acid soap in which said fatty acids contain from about 8 to about 18 carbon atoms and have a percentage of trans fatty acids of less than about 15%;

B. from about 0.5% to about 5% of free fatty acid containing from about 8 to about 18 carbon atoms;

C. no more than about 0.65% of salt when the free fatty acid content is at about 1% or less and for each additional about 1% of free fatty acid that is present the maximum salt content is reduced by about one-tenth of 1%; and D. from 18% to 30% moisture.

10. The composition of claim 9, wherein said percentage of trans fatty acids is less than about 14%.

11. The composition of claim 2 wherein said fatty acid soap and said free fatty acids are derived from a blend of (1) tallow fatty acids and (2 fatty acids selected from the group consisting of coconut oil fatty acids, palm kernel oil fatty acids, and mixtures thereof in ratios of (1) to (2) of from about 70:30 to about 50:50.

12. The composition of claim 11 wherein said percentage of trans fatty acids is less than about 14%.

* * * * *